US012650244B2

(12) United States Patent
Armstrong et al.

(10) Patent No.: US 12,650,244 B2
(45) Date of Patent: Jun. 9, 2026

(54) HEATING SYSTEMS

(71) Applicant: Mixergy Limited, Oxfordshire (GB)

(72) Inventors: Peter Armstrong, Oxfordshire (GB); Geraint Lloyd, Oxfordshire (GB); Christopher Randall, Oxfordshire (GB)

(73) Assignee: Mixergy Limited, Thame (GB)

( * ) Notice: Subject to any disclaimer, the term of this patent is extended or adjusted under 35 U.S.C. 154(b) by 394 days.

(21) Appl. No.: 18/266,628

(22) PCT Filed: Dec. 10, 2021

(86) PCT No.: PCT/GB2021/053242
§ 371 (c)(1),
(2) Date: Jun. 12, 2023

(87) PCT Pub. No.: WO2022/123266
PCT Pub. Date: Jun. 16, 2022

(65) Prior Publication Data

US 2024/0044550 A1 Feb. 8, 2024

(30) Foreign Application Priority Data

Dec. 10, 2020 (GB) ..... 2019459

(51) Int. Cl.

| | |
|---|---|
| ***F24H 15/168*** | (2022.01) |
| ***F24D 3/18*** | (2006.01) |
| ***F24D 19/10*** | (2006.01) |
| ***F24H 15/223*** | (2022.01) |
| ***F24H 15/231*** | (2022.01) |
| ***F24H 15/232*** | (2022.01) |

(52) U.S. Cl.
CPC ..... *F24H 15/168* (2022.01); *F24D 3/18* (2013.01); *F24D 19/1039* (2013.01);
(Continued)

(58) Field of Classification Search
CPC .... F24H 15/168; F24H 15/223; F24H 15/231; F24H 15/232; F24H 15/254;
(Continued)

(56) References Cited

U.S. PATENT DOCUMENTS

2005/0165511 A1* 7/2005 Fairlie ..... H01M 8/184 700/286
2007/0198133 A1* 8/2007 Hirst ..... H02J 3/14 700/295
(Continued)

FOREIGN PATENT DOCUMENTS

CN 108895719 11/2018
DE 102017220414 5/2019
(Continued)

OTHER PUBLICATIONS

International Search Report and the Written Opinion Dated Mar. 17, 2022 From the International Searching Authority Re. Application No. PCT/GB2021/053242. (12 Pages).
(Continued)

*Primary Examiner* — Kidest Worku

(57) ABSTRACT

A heating system (100), a controller (110) for a heating system and a method of controlling a heating system (100) suitable for responding to grid stress events are disclosed. A heating system (100) comprises a tank (104) for holding water; a heat pump (102) arranged to provide heat to the tank (104); an electric heating element (108) disposed in the tank for heating water; and, a controller (110) configured to: control electric power from an electric power grid to the heat pump (102) and the electric heating element (108); detect a grid stress event; determine a heat pump energy penalty for providing heat in response to the grid stress event under a present operating condition; and, vary, in dependence on the
(Continued)

determined heat pump energy penalty, a power provided to the electric heating element (108).

22 Claims, 5 Drawing Sheets

(52) U.S. Cl.
CPC ..... *F24H 15/223* (2022.01); *F24H 15/231* (2022.01); *F24H 15/232* (2022.01)

(58) Field of Classification Search
CPC ..... F24H 15/375; F24H 15/421; F24H 4/04; F24H 7/002; F24H 9/2021; H02J 2310/14; H02J 2310/60; H02J 3/14; H02J 3/241; Y02B 70/30; Y02B 70/3225; Y04S 20/222; Y04S 20/242; Y04S 20/244; Y04S 50/16; Y04S 50/10; Y04S 20/12; Y04S 20/20; Y04S 20/30; Y04S 10/12; Y04S 10/14; Y04S 10/16; Y04S 10/18; Y04S 10/30
See application file for complete search history.

(56) References Cited

U.S. PATENT DOCUMENTS

2010/0209084 A1* 8/2010 Nelson ..... F24H 15/12 62/238.7
2011/0118891 A1* 5/2011 Hirst ..... H02J 3/241 700/295
2013/0205814 A1* 8/2013 Hayashida ..... F24H 15/212 62/235.1
2015/0019023 A1* 1/2015 Kotake ..... G05F 1/66 700/276
2015/0142202 A1* 5/2015 Flohr ..... F24H 1/202 700/297
2015/0316901 A1* 11/2015 Wenzel ..... G05B 13/048

FOREIGN PATENT DOCUMENTS

| | | |
|---|---|---|
| DE | 102018213785 | 2/2020 |
| EP | 0240441 | 10/1987 |
| EP | 3392997 | 10/2018 |
| WO | WO 2022/123266 | 6/2022 |

OTHER PUBLICATIONS

Patents Act 1977: Combined Search and Examination Report Under Sections 17 and 18(3) Dated May 26, 2021 From the Intellectual Property Office of the United Kingdom of Great Britain Re. Application No. GB2019459.3. (5 Pages).
Patents Act 1977: Search Report Under Section 17 Dated May 31, 2022 From the Intellectual Property Office of the United Kingdom of Great Britain Re. Application No. GB2117866.0. (4 Pages).

* cited by examiner

HEATING SYSTEMS

RELATED APPLICATIONS

This application is a National Phase of PCT Patent Application No. PCT/GB2021/053242 having International filing date of Dec. 10, 2021, which claims the benefit of priority of Great Britain Patent Application No. 2019459.3 filed on Dec. 10, 2020. The contents of the above applications are all incorporated by reference as if fully set forth herein in their entirety.

FIELD AND BACKGROUND OF THE INVENTION

This invention relates to improvements in heating systems, particular to the control of heating systems in response to grid stress events.

With increasing demands for lower energy consumption, heat pumps are displacing the use of gas boilers in many developed economies. Such systems are also used for air-conditioning applications in warmer regions or for commercial premises with high solar gain in cooler/temperate regions. Some systems cater to both cooling and space heating depending on the time of the year. There is usually a coupling of the hot water system to the heat pump with a hot water tank. It would be expensive and inefficient to build a heat-pump with the instantaneous heating capability required by domestic potable hot water applications such as power showers; it would also be very slow for hot water to be delivered from a cold start with a heat pump without any form of hot water storage.

Simultaneously, in many developed economies, electric power systems are migrating from a few large centralised power stations to many distributed generation systems such as roof-top solar photovoltaics (PV), wind turbines and small biomass/anaerobic methane generation facilities and other renewable energy sources. Traditional centralised grid architectures are relatively easy to control due to the large amount of system inertia delivered by huge rotating turbines, alongside the ability to store enormous reserves of quickly dispatchable energy at central generation sites in the form, for example, of coal heaps, uranium pellets and tanks of methane. With a more distributed infrastructure, based largely around non-dispatchable sources of renewable energy, system stability and security of supply becomes more challenging with less system inertia and lower reserves of standby generation to deal with large fluctuations in demand. Increasingly, both surpluses and deficits of renewable energy with respect to demand are causing challenges to the power grid. These challenges include a struggle to maintain the power grid frequency within nominal limits (e.g. 50 Hz+/−0.1 Hz in the UK) and distribution network voltages within allowable levels (e.g. 230 V+10%/−6% in the UK).

To address these problems, heating systems drawing power from the electric power grid may be configured to draw more or less power from the grid dependent on grid stress events, such as a sudden change the capacity of the grid. For example, in response to a grid stress event such as a large amount of solar energy, or very low anticipated energy demand, a heating system can soak up surplus energy through heating a hot water tank to a higher state of charge or elevating the temperature of an underfloor heating slab by a few degrees—in essence storing the surplus energy locally. It is a problem for heating systems to do this in a way that balances the needs of the user with the needs of the grid operator (also referred to as an electrical power transmission system operator). It may also be a problem to control which elements of the heating system might be best placed to use the surplus energy in a way that provides maximum utilisation of the surplus energy. It is also a problem the grid stress events are transient and may be unpredictable and may require very fast response from a heating system, and the event may be of unknown duration.

The present invention aims to ameliorate, at least in part, these and other problems.

SUMMARY OF THE INVENTION

Aspects and embodiments of the present invention are set out in the appended claims.

According to a first aspect, a heating system is provided which comprises a tank for holding water, a heat pump arranged to provide heat to the tank, an electric heating element disposed in the tank for heating water, and a controller configured to control electric power from an electric power grid to the heat pump and the electric heating element, detect a grid stress event, determine a heat pump energy penalty for providing heat in response to the grid stress event under a present operating condition, and vary, in dependence on the determined heat pump energy penalty, a power provided to the electric heating element.

This may be advantageous in permitting a heating system to react to a grid stress event in a manner that uses energy more efficiently and reduces wear and tear on the heat pump.

The system may further comprise one or more of: a mains sensor arranged to measure a mains current frequency and/or a mains voltage for detecting a grid stress event; and a heat meter arranged to measure a heat flow of the heating system for determining the heat pump energy penalty in dependence on a characteristic performance profile of the heat pump. Preferably the system includes a plurality of heat meters. A heat meter preferably comprises a flow meter and a pair of temperature sensors. The mains sensor may include a voltage sensor and/or a current sensor. The mains sensor may advantageously transmit data to the controller by which the controller can detect a grid stress event. The heat meter(s) may advantageously transmit data to the controller, in dependence on which the controller may determine the heat pump energy penalty.

Optionally, the one or more heat meters are configured to measure one or more of: (a) a heat flow from the heat pump to a space heating system; (b) a heat flow from an air-conditioning system to the heat pump; (c) a heat flow from the heat pump to the tank; and (d) a heat flow of any combination of (a)-(c).

Optionally, a grid stress event may comprise a signal received from a grid operator, optionally wherein the signal is a prompt to increase or decrease an energy usage, optionally for a duration of time.

Optionally, the grid stress event may comprise a change in a mains current frequency. The controller may be configured to determine that a grid stress event is occurring if a sensed mains current frequency passes threshold. The threshold may be in the range of 0.07 to 0.15 Hz above or below a nominal mains current frequency, preferably around 0.1 Hz above or below a nominal mains current frequency. The controller may be configured to determine that a grid stress event is occurring if a sensed mains current frequency rate of change passes a threshold. The threshold may be in the range of 0.07 to 0.15 Hz/second, preferably around 0.1 Hz/second.

Optionally, the controller may be configured to vary the power delivered to the heating element and/or heat pump in proportion to the departure from a specified frequency threshold or the time rate of change of the departure from a frequency threshold.

Optionally, the grid stress event may comprise a change in a mains voltage. The controller may be configured to determine that a grid stress event is occurring if a sensed mains voltage passes a threshold. The threshold may be in the range of 7 to 15% above a nominal mains voltage, or 3-10% below a nominal mains voltage. The threshold may be around 10% above a nominal mains voltage or around 6% below a nominal mains voltage. The controller may be configured to determine that a grid stress event is occurring if a sensed mains voltage rate of change passes a threshold. The threshold may be in the range of 7 to 15% per second, preferably around 6% per second.

Optionally, the controller may be configured to determine a predicted duration of the grid stress event.

Optionally, the predicted duration of the grid stress event may be determined based on a model. The model may comprise historical data. The model may be a trained model trained on historical data. The predicted duration of the grid stress event may be determined in dependence on a rate of change in a mains current frequency and/or a rate of change in a mains voltage.

Optionally, the controller may be configured to classify the grid stress event as having: (i) a known duration, or (ii) an unknown duration.

Optionally, the controller may be configured to determine the heat pump energy penalty in dependence on a known or predicted duration of the grid stress event.

Preferably, the controller may be further configured to determine a user heating requirement, determine the heat pump energy penalty in dependence on the user heating requirement and, select, in dependence on the determined heat pump energy penalty, either the heat pump or the electric heating element to satisfy the user heating requirement.

Preferably, the user heating requirement may be a user heating schedule and/or a user hot water demand schedule.

Preferably, the controller may comprise an optimisation algorithm configured to determine the heat pump energy penalty. The optimisation algorithm may be a simplex algorithm or a recurrent neural network.

Preferably, the present operating condition may comprise one or more temperature measurements.

Optionally, the one or more temperature measurements may comprise one or more of: a temperature of a condenser of the heat pump, a temperature of an evaporator of the heat pump, a temperature of a space to be heated by the heating system, a temperature of a space to be cooled by the heating system, a temperature of hot water held in the tank, a temperature of hot water at a point along the heating system and, a temperature of refrigerant at a point along the heating system.

Preferably, the controller may be configured to determine the heat pump energy penalty in dependence on a characteristic performance profile of the heat pump. The performance profile may comprise a model of how a coefficient of performance of the heat pump varies on providing power to the heat pump under the present operating condition.

Optionally, the controller may be configured to determine the heat pump energy penalty in dependence on a fatigue factor of the heat pump, preferably wherein the fatigue factor may comprise a model of how a coefficient of performance of the heat pump decreases over on-off cycles of the heat pump.

Optionally, the characteristic performance profile may be determined in dependence of a plurality of historic measured heat flows of the heating system.

Optionally, the controller may be configured to receive data from a remote server. Optionally the remote server may be a remote server of the grid operator. The data may comprise a signal from the grid operator associated with a grid stress event.

Preferably, the controller may be configured to vary the power to the heat pump in dependence on the heat pump energy penalty. The controller may be configured to vary the power to the heat pump by varying the power supplied to the compressor of the heat pump.

Preferably, the controller may be configured to vary the power to the electric heating element by controlling an on-off switching device, preferably one of: a relay, a TRIAC, a MOSFET or an IGBT.

To provide further flexibility, the system may further comprise: a buffer vessel arranged between the heat pump and the tank for storing fluid circulated by the heat pump; a buffer vessel heater for directly heating fluid in the buffer vessel, wherein the controller may be further configured to control electric power from the electric power grid to the buffer vessel heater and vary, in dependence on the determined heat pump energy penalty, a power provided to the buffer vessel heater.

Optionally, the controller may be further configured to: determine a user heating requirement; determine the heat pump energy penalty in dependence on the user heating requirement; and select, in dependence on the determined heat pump energy penalty, the heat pump, the electric heating element or heat stored in the buffer vessel to satisfy the user heating requirement.

According to another aspect of the invention a heating system is provided comprising: a water heating system for heating potable water or a space heating system; a heat pump arranged to provide heat to the water heating system or a space heating system; a buffer vessel arranged between the heat pump and the water heating system or space heating system for storing heated fluid circulated by the heat pump; a buffer vessel heater for directly heating fluid in the buffer vessel; a controller configured to: control electric power from an electric power grid to the heat pump and the buffer vessel heater; detect a grid stress event; determine a heat pump energy penalty for providing heat in response to the grid stress event under a present operating condition; and, vary, in dependence on the determined heat pump energy penalty, a power provided to the buffer vessel heater.

Preferably, the buffer vessel heater comprises an electric heating element disposed in the buffer vessel for heating fluid in the buffer vessel.

Optionally, the one or more heat meters may be configured to measure a heat flow to or from a buffer vessel.

Optionally, the one or more temperature measurements may comprise a temperature of fluid in the buffer vessel.

According to another aspect of the invention a controller for a heating system is provided which comprises a grid stress event detector for detecting a grid stress event, a sensor data receiver for receiving sensor data, a processor configured to determine a heat pump energy penalty for providing heat in response to a grid stress event in dependence on received sensor data, and a power control module configured to vary the power provided to an electric heating element in dependence on the heat pump energy penalty.

The controller may further be configured to vary, in dependence on the determined heat pump energy penalty, a power provided to the heat pump.

The controller may be as aforementioned. The controller may be adapted for use in a system as aforementioned. The sensor data may determine a present operating condition. The grid stress event detector may be adapted to receive mains sensor data, preferably from a mains sensor.

According to another aspect of the invention there is provided a controller, optionally as aforementioned, configured to determine, in dependence on a heat pump energy penalty, a distribution of power between an electric heating element and a heat pump in response to a grid stress event. The controller may be adapted for use in a system as aforementioned. According to another aspect there is provided a controller, optionally as aforementioned, configured to determine, in dependence on a heat pump energy penalty, whether to provide power to an electric heating element, to a heat pump, to both or to neither in response to a grid stress event. The controller may be adapted for use in a system as aforementioned. According to another aspect there is provided a controller, optionally as aforementioned, configured to provide power to a heat pump or an electric heating element or both or neither in response to a grid stress event. The controller may be adapted for use in a system as aforementioned.

According to another aspect of the invention, a method of controlling a heating system comprising a tank for holding water; a heat pump arranged to provide heat to the tank; and an electric heating element disposed in the tank for heating water is provided. The method may comprise detecting a grid stress event, determining a heat pump energy penalty for providing heat in response to the grid stress event under a present operating condition, and varying, in dependence on the determined heat pump energy penalty, a power provided to the electric heating element.

The controller may further be configured to vary, in dependence on the determined heat pump energy penalty, a power provided to the heat pump.

The method may be adapted for a system as aforementioned.

According to another aspect, a heating system is provided which comprises a tank for holding water, a heat pump arranged to provide heat to the tank, an electric heating element disposed in the tank for heating water, and a controller configured to control electric power from an electric power grid to the heat pump and the electric heating element, detect a grid stress event, determine a heat pump energy penalty for providing heat in response to the grid stress event under a present operating condition, and vary, in dependence on the determined heat pump energy penalty, a power provided to the electric heating element and/or to the heat pump.

The heating system may be as aforementioned.

According to another aspect, a controller as aforementioned is provided.

According to another aspect, a method of controlling a heating system comprising a tank for holding water; a heat pump arranged to provide heat to the tank; and an electric heating element disposed in the tank for heating water is provided. The method may comprise detecting a grid stress event, determining a heat pump energy penalty for providing heat in response to the grid stress event under a present operating condition, and varying, in dependence on the determined heat pump energy penalty, a power provided to the electric heating element and/or to the heat pump.

The method may be adapted for a system as aforementioned.

As used herein, the term "tank" preferably connotes a cylinder, vessel or other suitable container for storing heated water, such as a water tank in a domestic hot water system.

While the invention has been described herein, in part, in relation to heating water, the skilled person will appreciate that the invention is not limited only to heating water and may potentially be used to heat any suitable fluid.

While the invention has been described herein, in part, in relation to a combined 'whole-house' heating and hot water system heating water, the skilled person will appreciate that the invention is not limited only domestic heating systems.

While the invention has been described herein, in part, in relation to heat pumps being used to heat space or fluid, the skilled person will appreciate that the invention is not limited only to uses of a heat pump to provide heating, but may also apply to systems for cooling space or fluid or systems capable of both heating and cooling space and fluid by means of a heat pump.

References to transmission and reception of data, or communication by wired or wireless means will be understood to encompass transmission, reception and communication via any suitable means, for example, WiFi, Bluetooth, fiberoptic cables, local area networks, the world wide web, infrared signals etc.

Any system or apparatus feature as described herein may also be provided as a method feature, and vice versa. As used herein, means plus function features may be expressed alternatively in terms of their corresponding structure.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

DESCRIPTION OF SPECIFIC EMBODIMENTS OF THE INVENTION

Figure 1:
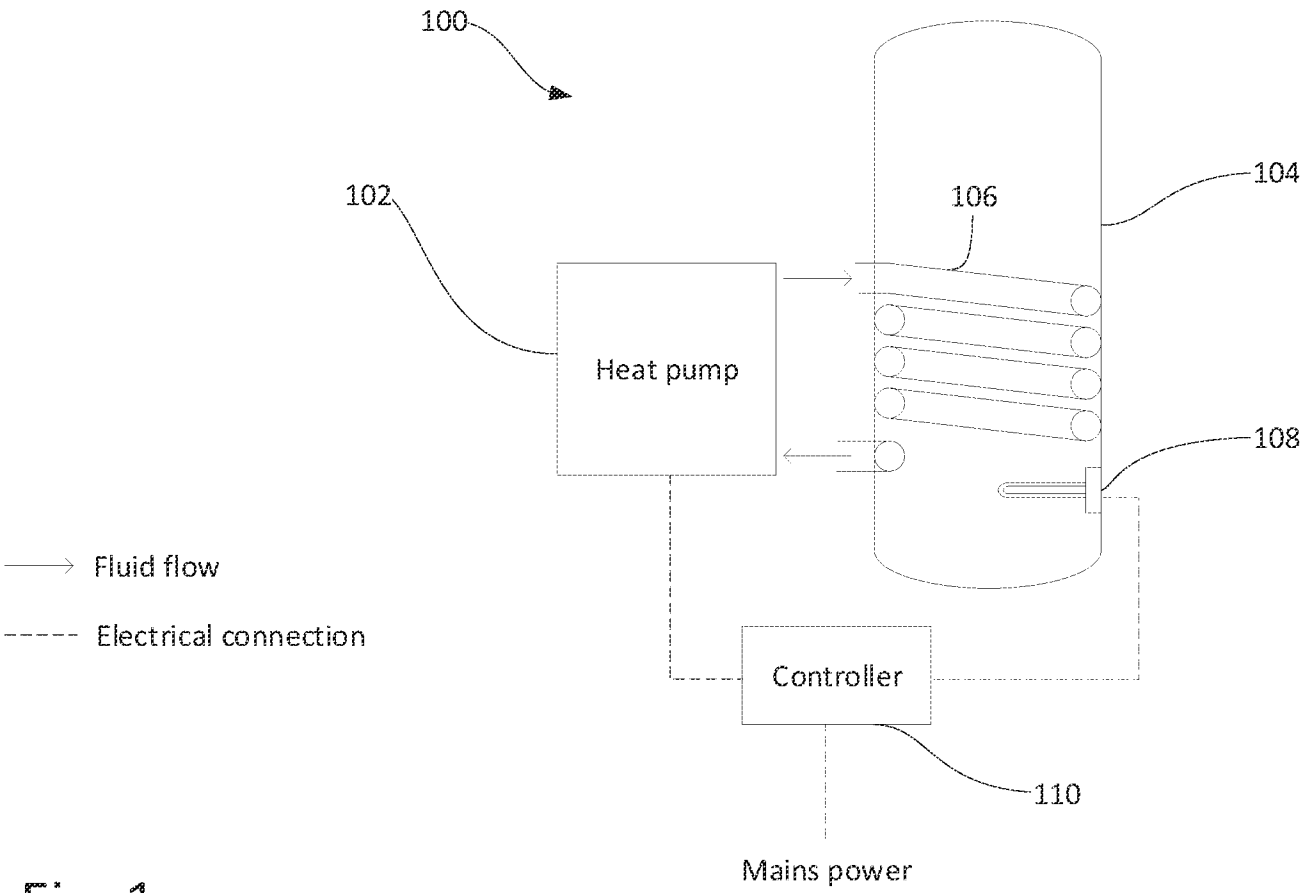
FIG. 1 shows a heating system according to an embodiment of the invention.

FIG. 1 shows a heating system 100 according to a first exemplary embodiment of the invention. The system includes a heat pump 102 for heating water in a tank 104 via a heat exchanger 106. Inside the tank 104 is there is an electric heating element 108, also for heating water in the tank 104. A controller 110 controls the heat pump 102 and the electric heating element 108. The heat pump 102 may also be configured to provide heating or cooling, via the heating system 100, to a space or room in a building either instead of, or in addition to, heating water in the tank 104, as will be discussed in more detail later.

The tank 104 is generally cylindrical with a dome-shaped base and a dome-shaped top, which may be referred to as "relief domes". A main 'cold' inlet (not shown) is arranged in the tank base for filling and/or replenishing the tank 104 with water, preferably from a mains water supply, and a main 'hot' outlet (not shown) arranged in the tank top, through which heated water may be drawn for use. A heat exchanger 106 is disposed in the tank 104 for heating the water, the heat exchanger 106 in this example being arranged as a helical coil and arranged towards the bottom of the cylindrical portion of the tank 104. In one of many possible alternatives, the heat exchanger 106 may be tapered to contour with the domed shape of the base. The heat exchanger 106 has an inlet and outlet for connection to the heat pump 102.

The heat pump 102 is arranged to provide heat to the tank 104 via the heat exchanger 106. One skilled in the art will understand that a heat pump 102 typically has four main components: a compressor, a high-pressure heat exchanger (commonly termed a condenser), an expander and a low-pressure heat exchanger (commonly termed an evaporator). These components are illustrated in more detail in FIG. 4. A refrigerant is circulated between these components to absorb heat from a heat source by the evaporator and to transfer the heat to a heat sink by the condenser.

The heat pump's refrigerant must reach a sufficiently high temperature upon being compressed by the compressor in order to release heat through the condenser. Similarly, the fluid must reach a sufficiently low temperature upon being expanded through the expander so that heat may be absorbed from the heat source at the evaporator. The pressure difference must be great enough for the fluid to condense in the condenser and still evaporate in the evaporator. As such, the compressor must work harder (i.e. it requires a larger power input) to compress the refrigerant when the temperature difference between the heat source and the heat sink is greater. The temperatures of the heat sink and the heat source are examples of operating conditions of the heat pump 102 which have an effect on the performance of the heat pump 102.

The coefficient of performance of the heat pump 102 is a ratio of the amount of thermal energy moved (i.e. from heat source to heat sink) per unit of input work (i.e. work done by the compressor) and typically used to quantify the performance of a heat pump 102. The coefficient of performance of the heat pump 102 depends on the operating conditions of the heat pump 102. The optimal coefficient of performance under a given set of operating conditions is typically reached once the heat pump 102 has achieved a steady state operation.

The amount of useful heat transfer effected by the heat pump 102 will vary based on a number of factors, including the amount of power being delivered to the heat pump 102, the present operating conditions of the heat pump 102 and the coefficient of performance. The dependence of the heat flow (heat output or heat input or balance of several heat in- and outputs) provided by the heat pump 102 on the power supplied to the heat pump 102 and the operating conditions can be characterised by a performance profile of the heat pump 102. This may be a theoretical model of the behaviour of the heat pump 102 under various operating conditions, it may also be an empirical model built from collected performance data of the heat pump 102. It may be particularly advantageous for the characteristic performance profile of the heat pump 102 to comprise a model of how the coefficient of performance of the heat pump 102 varies when power is provided to the heat pump 102 under various operating conditions. This may be a model only of the steady state behaviour of the heat pump 102, or more advantageously a model of the time-varying coefficient of performance of the heat pump 102 throughout an on-off cycle of the heat pump 102.

For example, given a set of current operating conditions, the characteristic performance profile of the heat pump 102 can enable estimating the coefficient of performance of the heat pump 102 if the power is applied for e.g. 3 or 5 minutes. Given an estimated duration of a grid stress event (e.g. 2 or 3 or 5 minutes) and a set of current operating conditions (temperatures at various points in the heating system) the characteristic performance profile can be used to estimating the operating state (i.e. the performance state) that can be achieved during the grid stress event. This can permit assigning a heat pump energy penalty to powering the heat pump 102 in response to a grid stress event where the heat pump 102 is made to operate for a short period and may not reach a steady state or maximum performance.

A heat pump energy penalty can be calculated to represent an energy cost that may be incurred in starting up the heat pump 102. A heat-pump system might take in excess of 5 minutes to reach an efficient steady state mode of operation at which it achieves it best performance. The heat pump energy penalty may represent the energy invested in getting the refrigerant of the heat pump 102 and associated heat transfer surfaces (for example, those of the evaporator and the condenser) up to a temperature which begins yielding heat transfer with high coefficients of performance. In other words, the heat pump energy penalty may be measure of the energy expended in bringing the heat pump 102 to a steady state or maximum COP working condition. The heat pump energy penalty may thus include a measure of the energy losses associated with thermal-cycling the heat pump 102. For example, the heat pump energy penalty may account for the energy expended when the heat pump 102 is first turned on to initially pressurise the refrigerant. The heat pump energy penalty may also account for energy lost from the heating system 100 to the ambient environment, i.e. 'useless' heat being delivered to areas that are not the target of the heating since a heating system 100 may contain many 'escape routes' for the heat energy to be lost. The heat pump energy penalty might be considered a 'on-cost' or a 'start-up cost' associated with turning on, or on-off cycling a heat pump 102.

The heat pump energy penalty may be a function of the initial state of a refrigerant, for example the refrigerant temperature and/or pressure at one or more points in the heat pump 102; system loop temperatures (that is temperatures at points within the heating system circuit which circulates fluid heated or cooled by the heat pump 102 around the system; ambient temperatures of spaces from which (to which) thermal energy is being drawn (discharged); temperatures of the hot water store (which may be different at different heights in the hot water tank 104 due to thermal stratification).

The heat pump energy penalty may also include a 'fatigue factor' to parametrise the wear and tear caused to the heat pump 102 caused by power cycling the heat pump 102. The fatigue factor may be a model of how a coefficient of performance of the heat pump 102 decreases over on-off cycles of the heat pump 102. Each time the heat pump 102 is switched on there is some fatigue or wear and tear, caused, in particular, to the compressor of the heat pump 102, and the motor which drives the compressor. The fatigue factor may be an additional multiplicative or additive factor to the heat pump energy penalty. The fatigue may also help to quantify other performance degradations of the heat pump 102 over time or number of on-off cycles: such as leaking of the refrigerant.

The heat pump 102 may be a split or monobloc system. The heat pump 102 might be an air-source or ground-source heat pump 102 or any other suitable arrangement of heat pump 102 appropriate to the needs of the user of the heating system 100.

The electric heating element 108 is disposed inside the tank 104. The heater is mounted in a heater port (sometimes referred to as an "immersion port") provided in the tank 104. The heater is, preferably, arranged to be screwed into the port, which may be provided with a threaded "boss" for that purpose. The heater in this example is an "immersion heater", which includes a heating element having terminals for connecting the heating element to an electrical power supply (not shown). The terminals are housed in a 'plug' (or base), which is arranged to be secured into the "immersion" heater port provided in the tank 104, preferably via a screw-thread engagement.

The electric heating element 108, being disposed in the hot water tank 104, and generally submerged in water has very few possible escape routes for energy to be lost to the ambient environment. Once switched on, the electric heating element will deliver heat to the water and very quickly attain its maximum coefficient of performance (which for a resistive electric heating element will not exceed 1). Therefore, an 'electric heater energy penalty', analogous to that of the heat pump 102, is likely to be much less than the heat pump energy penalty and may be negligible. Electric heaters also tend to be very reliable in the face of many short power cycles. That is, an 'electric heater fatigue factor' would most likely be far smaller than a heat pump fatigue factor.

It may therefore be advantageous, under certain operating conditions, to satisfy a demand for energy using the electric heating element 108 rather than using the heat pump 102, or vice-versa. In particular, a demand for increased energy use for a very short time period will typically favour use of the electric heating element 108.

The controller 110 is configured to delivery power from the electric power grid to the heat pump 102 and the electric heating element 108. The controller 110 can direct the mains power to either one or both the heat pump 102 and the electric heating element 108 to satisfy a user's demand for heating, cooling or hot water. The controller 110 can determine the amount of power to be delivered to the heat pump 102 and to the electric heating element 108 in order to deliver the desired amount of heat to the heating system as efficiently as possible.

A user of the controller 110 may program, via a user interface of the controller 110, their heating or hot water requirements. The user hot water requirements may comprise a heating schedule for the user's home. For example, in the winter a user may program the heating system to heat the home early in the morning when they wake up and in the late evening when they return from work; in the summer, a user may select a schedule to cool the whole home, or a specific room, during the hottest parts of the day. A user schedule may also comprise, for example, a period in which they anticipate hot water demand to be high, for example early in the morning when members of the household may shower. The user requirements may comprise desired temperatures for certain rooms in the home or a demand that hot water to be delivered instantly (or as soon as possible) or at a particular later time or for a particular duration. The user schedule, or a set of user energy requirements may be programmed directly into the controller 110, programmed via an interface such as a mobile app or synthesised from a learning algorithm trained on the user's usage habits.

The controller 110 may be configured to vary the power the electric heating element 108 and the heat pump 102 in a way that wastes as little energy as possible, and causes the least possible wear and tear to the heating system (particularly the heat pump 102) while still satisfying the demands of the user.

The controller 110 may also be configured to vary the power provided to the heat pump 102 and/or the electric heating element 108 due to present operating conditions of the heating/hot-water system. For example, heat losses or temperature drops due to standing heat losses in a hot water tank 104 may require the heat pump 102 and/or the electric heating element 108 to restore the tank 104 to a desired standby state or to reheat a room back to a nominal temperature within an allowable hysteresis margin.

The controller 110 is configured to satisfy the user's heating requirements by controlling the amount of power delivered to the heat pump 102 and/or the electric heating element. Preferably, an algorithm may be embedded in the controller 110 to determine whether a user requirement may be most efficiently achieved by means of the electric heating element or by means of the heat pump 102. It is therefore advantageous for the controller 110 to determine the heat pump energy penalty that would be incurred by the heat pump 102 if it were to be used to satisfy the user's demand for energy usage, in order to inform a decision as to whether to switch on the heat pump 102 or the electric heating element 108.

For example, if a user requires an very short term delivery of hot water, it may well be that it is preferable to switch on the electric heating element 108 in order to heat water in the tank 104 to the required temperature to meet the user's demand—switching the heat pump 102 on for such a short period of time may be inefficient if the duration of the requirement is so short that the heat pump 102 would not have time to achieve a steady state operation before the event is over, and would be operating with a low coefficient of performance for the duration of the heating event. In other words there may be a large heat pump energy penalty associated with satisfying the user requirement. Similarly, for a long term period of heating or cooling the heat pump 102 may well be a more efficient choice than the electric heating element 108, since once the heat pump 102 has reached a steady state of operation, then its coefficient of performance can far outstrip that of the electric heating element 108.

However, the user requirement for heating or cooling or demand for hot water is not the only event to which a heating system might have to operate in dependence on. A heating system may also need to react to grid stress events which may affect the supply of mains power from the grid to the heating system 100, or the amount of electricity that a user wants to use, or that a grid operator desires to be used by those connected to the grid at a particular time.

A grid stress event may necessitate that a heating system 100 increase or decrease its energy usage in order to reduce stress on the grid or to ensure that the grid remains within safe operational boundaries. As an example of a grid stress event, a scenario is considered in which a large amount of solar energy is available to the network due to good weather, or little anticipated energy demand is currently present in the grid network. The surplus energy can be soaked up by the heating system 100 in a number of ways, for example, by heating a hot water tank 104 to a higher state of charge or elevating the temperature of an underfloor heating slab by a few degrees, while still satisfying the needs of the user. Grid stress events alongside any other heating or cooling events (which might arise due to a user schedule or the changing temperatures within the hot water tank 104 or living spaces) are possible factors which the controller 110 takes into account in managing the hot water system.

Grid stress events might be said to broadly fall into two categories: anticipated grid stress events and unforeseen grid stress events.

Anticipated Grid Stress Events

Often a grid stress event is anticipated by the power grid operator, or utility or distribution network operator. The grid stress event may be due to a forecast weather front resulting in more wind with high pressure and lower cloud cover simultaneously delivering more solar power. These weather events might be known 12 to 24 hours in advance and so a grid operator may send a signal to a heating system 100 providing an instruction, suggestion or incentive to absorb or avoid consuming energy if it is able or required to do so.

Typically, such grid stress events are addressed via a price signal over discrete half hour time periods within the balancing mechanism that operates in most modern energy markets. In other words, the grid stress event duration is set by the cadence of the balancing market (15 mins to 30 mins) and the market participants have determined the amount of demand to be absorbed/curtailed by any individual system connected to the grid. These participants are likely to be utilities, aggregators and generation facilities.

Unforeseen Grid Stress Events

Another class of grid stress event arise during 'real-time' operation of the power grid. The balancing mechanism (typically an auction run by the system operator (e.g. National Grid in the UK)) within most energy systems is designed to ensure that the bulk of demand and supply is in balance over a manageable time frame (15 mins to 30 mins), however outside of these timepoints, there is no way that the balancing mechanism can cater to sudden unforeseen grid stress events such as: a bird striking a powerline, a transformer overheating and going off-line, or England losing the World Cup to Germany on penalties resulting in over a million kettles being turned on rather than fridges being opened for beer.

Unforeseen grid stress events may manifest themselves as changes in the grid current frequency, a parameter which is common everywhere throughout a synchronous grid power system. When energy supply is high with respect to demand, the frequency begins rising and when it is low with respect to demand it drops. The mains voltage of a user of or household may also change locally with respect to local distribution network conditions. For example, the mains voltage in a house might drop if a factory next door turns on a large induction motor. The mains frequency and supply voltage must stay within nominal limits otherwise devices powered by the mains can malfunction.

The challenge with unforeseen events of this sort are that they typically occur over much shorter timescales than anticipated grid stress events (typically on a timescale of seconds to several minutes). Standby frequency services in the UK have to be capable of running for as much as 20 minutes but in practice, over 95% of frequency driven grid stress events are less than 3 minutes in duration. A heat-pump system might take in excess of 5 minutes to reach an efficient steady state mode of operation where the energy invested in getting its refrigerant and associated heat transfer surfaces up to temperature begins yielding heat transfer with high coefficients of performance.

The improved heating system 100 provided by the invention can decide where to use surplus energy in response to a grid stress event by a determination of the heat pump energy penalty. The controller 110 can determine a heat pump energy penalty and can then, based on this calculated energy penalty, decide whether to satisfy the extra energy demand by switching on the heat pump 102 or the electric heating element 108.

Figure 2:
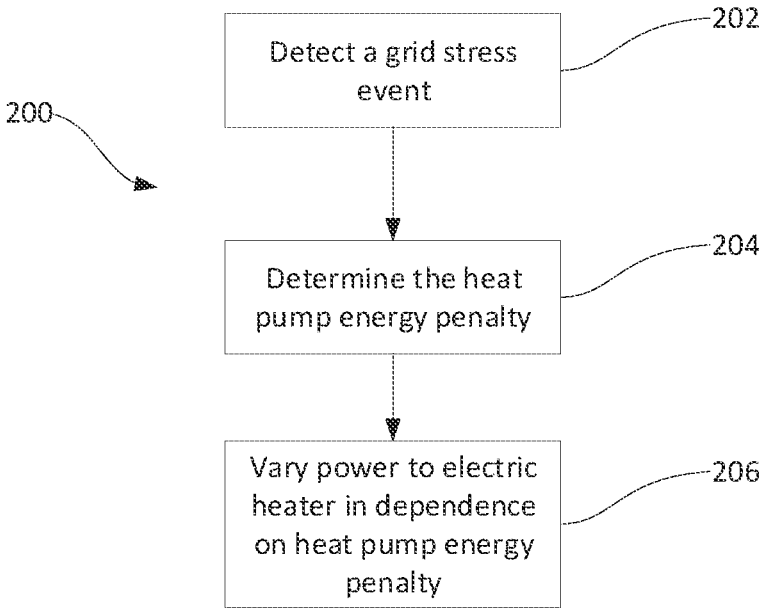
FIG. 2 is a flowchart of a method of controlling a heating system according to an embodiment of the invention.
Figure 3:
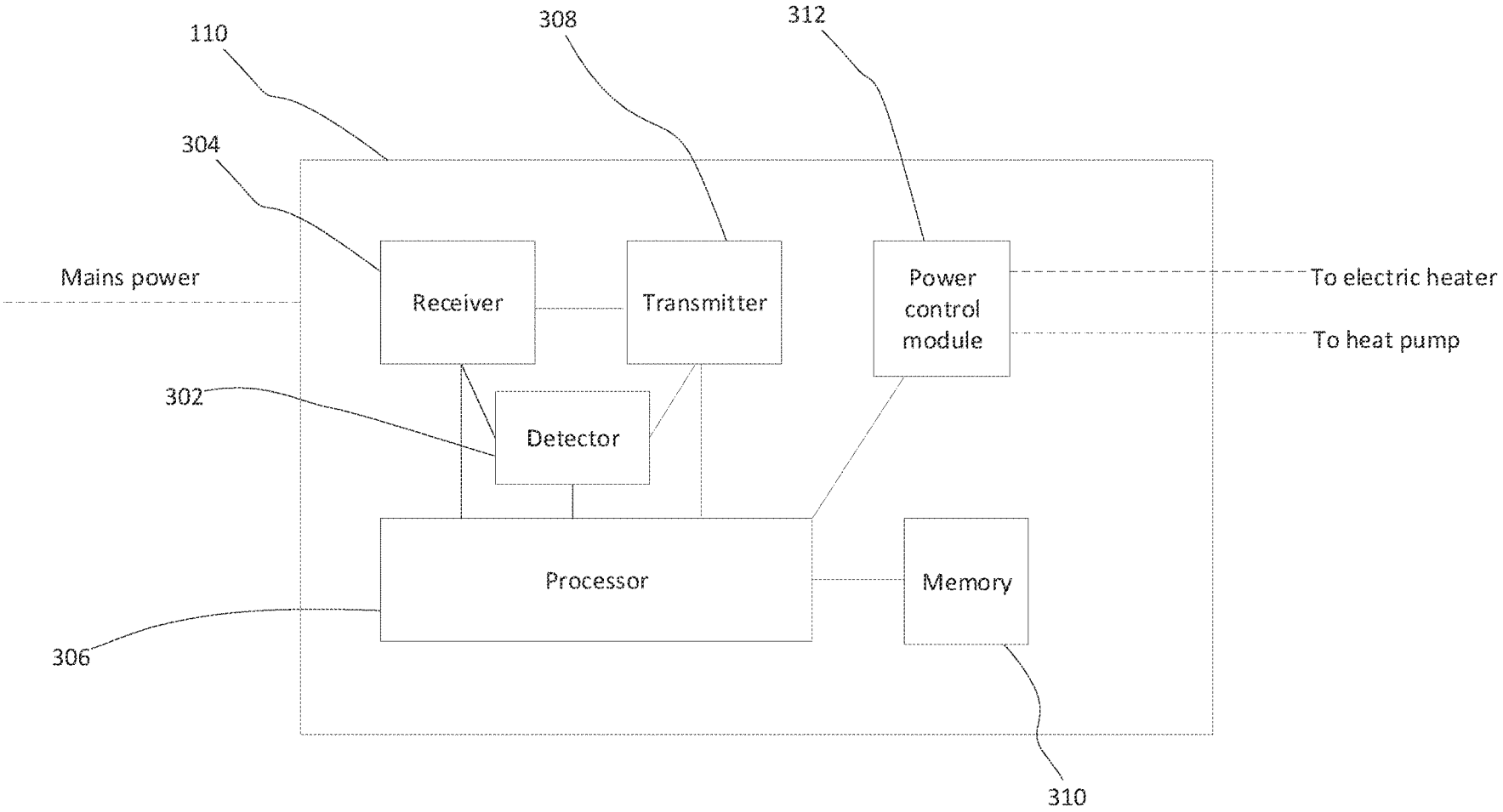
FIG. 3 is a module diagram of a controller for controlling a heating system.

FIG. 2 illustrates a method of operating the heating system 100 described above in accordance with a preferred embodiment of the invention. FIG. 3 illustrates a possible configuration of a controller 110 configured to perform such a method.

The controller 110 detects 202 a grid stress event. This may be done at a detector 302 or detection module configured for this purpose. The grid stress event may be inferred from data received by the controller 110 at a receiver 304. For example, sensor data may be received which shows that the local mains frequency or voltage has changed, which may necessitate the heating system 100 ramp up or down its energy usage. The controller 110 may also receive a signal from a grid operator indicating that energy usage should be increased or decreased, for example, for a 30-minute period in order to balance out the load on the grid network.

The controller 110 determines 204 the heat pump energy penalty under the present operating conditions of the heat pump 102 or heating system 100. The controller 110 may calculate the amount of power that would need to be delivered to the heat pump 102, and over what length of time, in order to use the amount of energy required to satisfy the grid stress event. The same may also be done for satisfying the event by use of the electric heating element 108. A thermal model, for example, describing the time to warm up water in the tank 104 to a desired state of charge, or the time to warm or cool a space to a desired temperature, may also contribute to the determination of the heat pump energy penalty. In the case of a grid stress event of unknown duration, the controller 110 may also calculate a predicted duration of the event. This predicted duration may be based on a model trained on data from previous grid stress events.

A processor 306 of the controller may be configured to perform the necessary calculations locally at the controller. The controller 110 may also be provided with a memory 312 on which data may be stored. This may be data related to the programmed user schedules, received sensor data, programs, models or algorithms stored for calculating the heat pump energy penalty or any other relevant information to the functions of the controller 110.

One example of calculating a predicted duration of a grid stress event may unfold as follows. For a frequency response event, the rate-of-change-of-frequency (ROCOF) as the frequency breaches a predetermined threshold indicating a grid stress event is likely to have a bearing on the grid stress event's duration. A high ROCOF going through a frequency set-point or threshold would indicate that system momentum is towards a significant frequency limit breach from which the system inertia will take time to recover, and vice-versa. More sophisticated approaches might make use of self-learning algorithms such as recurrent neural networks to build a model of the relationship between frequency and/or voltage measurements and the likely duration of unforeseen grid stress events.

Based on the determined heat pump energy penalty, the controller 110 determines whether to use the electric heating element 108 to satisfy the change in energy use instigated by the grid stress event. If the determined heat pump energy penalty is too great, then the controller 110 may respond to the grid stress event with energy use at the electric heating element 108.

The controller 110 will then vary 206 to the power to electric heating element 108 (e.g. by switching it on) by means of a power control module 312 to satisfy the grid stress event by heating the water in the tank 104 by the electric heating element 108. If the controller 110 deems that the heat pump energy penalty is acceptable then it may determine that the grid stress event can be satisfied by the heat pump 102. The controller 110 will then vary the power provided to the heat pump 102 (e.g. by switching on the heat pump 102) to satisfy the grid stress event by heating water in the tank 104 by the heat exchanger 106 in the tank 104 which is coupled to the heat pump 102, and/or by heating or cooling a space, for example by increasing the temperature of underfloor heating system or by air conditioning a room.

It will be appreciated that the determination of the heat pump energy penalty may be performed locally by the controller 110 on a processor 306 of the controller 110. It should also be understood that such processing may be performed at, for example, a remote processor. In this instance, the controller 110 is configured to determine a heat pump energy penalty by transmitting by the transmitter 308 any relevant data (for example, sensor data describing present operating conditions of the heating system 100, or information regarding the nature of the grid stress event) to the remote server, with a processor at the remote server computing the heat pump energy penalty. The remote server may also decide, based on the heat pump energy penalty, whether the grid energy event should be satisfied by the electric heating element 108 or the heat pump 102. The remote server may be configured to transmit data to the controller 110 comprising the calculated heat pump energy penalty, and/or the decision as to whether to use the heat pump 102 or electric heating element 108.

Figure 4:
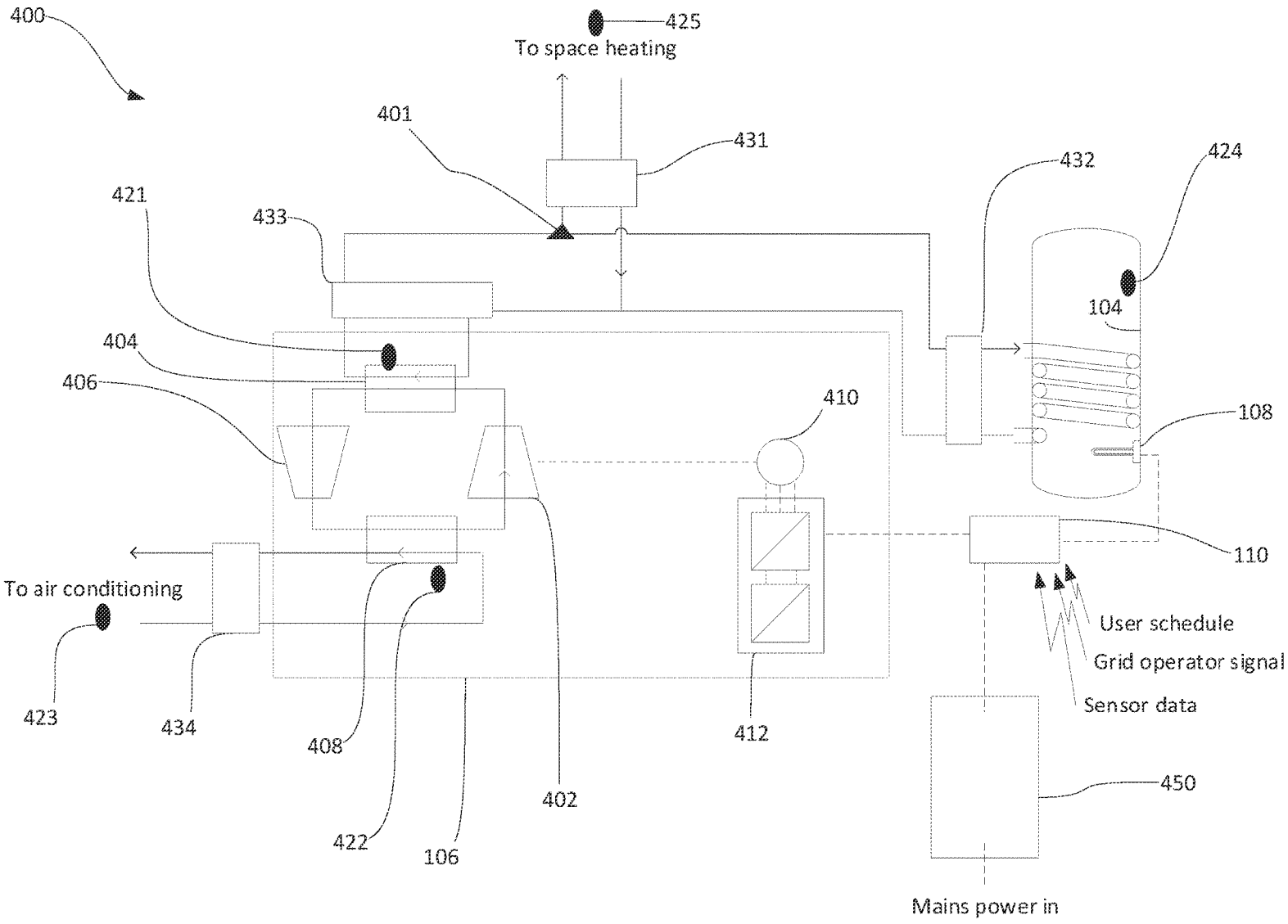
FIG. 4 shows additional features of a heating system according to certain embodiments of the invention.

FIG. 4 illustrates in more detail an embodiment of the present invention as applied to a whole house heating and hot water system 400.

One or more diverters or zone control valves 401 may be provided in the heating system 100 to control the flow of fluid between different portions of the heating system serving different purposes or different parts of the house. The illustrated zone control valve 401 is configured to permit fluid to flow to the space heating portion of the heating system 100, or the hot water tank 104, or to permit flow of fluid simultaneously to both. In general, such zone control valves may permit the heat pump 102 to provide heat to different portions of the heating system 100. The zone control valve 401 is controlled by the controller 110, and its position may vary in dependence on the user heating or hot water requirements, particularly if a user wishes to specifically enter a 'hot water mode' or a 'space heating mode' which may be programmable in the controller 110. The zone control valve 401 may also optionally be controlled in dependence on a grid stress event, on the present operating conditions, user requirements, heat pump energy penalty and any other factors which may determine whether it is preferable for water or space to be heated, or for particular portions of the heating system 100 to be addressed.

The heat pump 102 comprises a compressor 404, which pressurises and circulates a refrigerant (entering the compressor 402 in its gaseous state). On exiting the compressor 402, refrigerant is a hot and pressurised vapour which then is cooled in a condenser 404. The condenser 404 in the present embodiment is coupled to a conduit containing water (or another suitable fluid) which is heated by the heat exchanger and arranged to carry hot water away for use in space heating or to heat the hot water in the tank 104 via a heat exchanger 106 disposed in the tank 104. After passing through the condenser 404 the refrigerant is typically condensed into a high-pressure moderate temperature liquid. The condensed refrigerant then passes through a pressure-lowering device, the expander 406, which may be a turbine, expansion valve, capillary tube or any other such device. Upon exiting the expander 406, the refrigerant is now in a low-pressure fluid state. The refrigerant next passes through the evaporator 408, in which the refrigerant absorbs heat from the heat source and boils. The refrigerant then returns to the compressor 402 and the cycle is repeated.

The compressor 402 of the heat pump 102 is controlled by a motor 410. The motor 410 is coupled to an inverter 412 which may be configured to adjust the rotation speed of the motor 410 in response to a control signal from the controller 110. The motor 410 may be reversible by the inverter 412 thereby to switch the heat pump 102 between a space/water heating mode and a cooling or air-conditioning mode. The controller 110 may therefore be configured to turn on and off the compressor 402 or more generally to vary the power provided to the compressor 402, and by extension the heat pump 102.

The electric heating element 108 is an immersion heater located towards the bottom of the tank 104, in one example it is configured to heat water as it enters the tank 104 through a mains water inlet. The controller 110 is configured to control the power provided to the electric heating element. This can be achieved by coupling the controller 110 to the electric heating element 108 via an on-off switching device, such as a relay, a triode for alternating current (TRIAC), metal oxide semiconductor field effect transistor (MOSFET), or an insulated-gate bipolar transistor (IGBT).

A number of sensors 421, 422, 423, 424, 425, 431, 432, 433, 434 are provided throughout the exemplary heating system 100, which are configured to collect sensor data and transmit that data to the controller 110. The data may relate to present operating conditions of the heat pump 102 and of heating system 100 as a whole. This data may be relevant for determining the heat pump energy penalty in dependence on one or more of these present operating conditions.

Data may be transmitted from the sensors 421, 422, 423, 424, 425, 431, 432, 433, 434 to the controller 110 in real time (i.e. as a stream). The data may also be locally stored in a memory of the sensors 421, 422, 423, 424, 425, 431, 432, 433, 434 and transmitted in batches to the controller 110 at regular time intervals. The data may therefore also comprise a time that the measurement was taken. The controller 110 may also be configured to assign a timestamp to a datum received from a sensor. In the present embodiment, the sensors include sensors for measuring temperature, heat flow, current frequency, voltage, and power. A number of other sensors might be envisaged that could provide information relevant to present operating conditions of the heating system 100 or to the necessary functions of the controller 110, such as detecting grid stress events or determining the heat pump energy penalty or determining user energy demands. For example, a sensor to detect leakage of refrigerant from the heat pump 102 may be provided, or pressure sensors may be provided to detect ambient pressures or pressure in the water tank 104, thermostats may also be provided to detect input from a user who wishes to increase a temperature within their home or change a user schedule and communicate this to the controller 110.

In the illustrated embodiment, a number of temperature sensors 421, 422, 423, 424, 425 are provided. These temperature sensors 421, 422, 423, 424, 425 are configured to measure the temperature at various points around the heating system 100. The measurements are transmitted to the controller 110, by wired or wireless connections. The temperature measurements are examples of present operating conditions of the heating system 100. The temperature measurements may also be stored by the controller 110, or at a remote server or database, in order to build up a dataset of historical operating conditions of the heating system 100.

A first temperature sensor 421 is located proximate to the condenser 404 of the heat pump 102. This temperature may be used to determine how close to steady state operation the heat pump 102 is. The temperature at the compressor 402 is also a parameter that determines the (theoretical) COP of the heat pump 102. A calculation of the COP of the heat pump 102 under a present operating condition may contribute to a determination of the heat pump energy penalty.

A second temperature sensor 422 is located proximate to the heat source associated with the low-pressure heat exchanger. This temperature may also help in determining the theoretical COP.

A third temperature sensor 423 is located proximate to a space to be cooled by the heating system 100, or the cooling load on the heat pump 102. The sensor is configured to measure the temperature of a room or space to be cooled by the heat pump 102 running in a cooling or air-conditioning mode.

A fourth temperature sensor 424 is located in or proximate to the hot water tank 104 to measure a temperature of the water in the tank 104. This temperature may also help to determine the theoretical COP of the heat pump 102 when operating in a 'hot water' mode.

A fifth temperature sensor 425 is located in or proximate to a space to be heated by the heating system 100.

Each of these temperature sensors 421, 422, 423, 424, 425 may be configured to transmit the measured temperatures, by wired or wireless connection to the controller 110 and/or another connected device. The controller 110 may determine the heat pump energy penalty in dependence on this data. The controller 110 may also be configured to save in memory a record of the sensor data along with the determined heat pump energy penalty in order to create a record of historical performance data for the heat pump 102. Such data may be used to as a training data set to train a trained model for determining the heat pump energy penalty in dependence on such operating conditions.

A number of heat meters 431, 432, 433, 434 are also provided in the heating system 100. The heat meters 431, 432, 433, 434 measure flows of heat between points in the heating system 100. The heat meter 431, 432, 433, 434 may comprise a flow meter and a differential temperature sensor, such as a thermocouple, to detect a change in temperature between two points in the system. Alternatively, the heat meters 431, 432, 433, 434 may comprise two temperature sensors to determine the temperatures at two points in the system. Rather than a flow meter, the heat meters 431, 432, 433, 434 may be configured to infer a flow rate in the heating system 100 from system parameters such as motor speeds of motors which are driving the flow of fluid through the system.

In the illustrated embodiment, a first heat meter 431 is provided to measure the heat flow from the heat pump 102 to the space heating portion of the heating system 100.

A second heat meter 432 is provided to measure the heat flow to the tank 104.

A third heat meter 433 might be optionally provided to measure a total heat flow to the space heating and hot water tank 104 portions of the heating system 100 from the heat pump 102.

A fourth meter 434 is provided to measure the heat flow from the heat pump 102 to the air conditioning portion of the heating system 100.

Each of these heat meters 431, 432, 433, 434 may be configured to transmit the measured heat flow, by wired or wireless connection to the controller 110 and/or another connected device. The controller 110 may determine the heat pump energy penalty in dependence on this data. By measuring the heat flows within the system, the controller 110 can determine the amount of heat being transferred in order to determine the performance of the heat pump 102. The characteristic performance of the heat pump can therefore be built up from this data. The controller 110 may also be configured to save in memory a record of the determined heat pump energy penalty data along with the measured heat flows in order to create a record of historical performance data for the heat pump 102 under different operating conditions. Such data may be used to as a training data set to train a trained model for determining the heat pump energy penalty in dependence on such operating conditions. This data, along with other data relating to the operating conditions of the heating system 100 may be used to create a model of the characteristic performance profile of the heat pump 102.

The illustrated embodiment also provides means of making local measurement of mains voltage and frequency to determine the onset of grid stress events, particularly unforeseen grid stress events.

A mains sensor 450 is provided for sensing a change in the mains frequency. The mains sensor 450 may include an voltage sensor configured to measure the mains voltage. The frequency may be determined from the voltage sensor output using a zero crossing detection circuit or an analogue digital converter in conjunction with a digital signal processing module. The mains sensor 450 is configured to transmit the sensor data to the controller 110 thereby to allow to the controller 110 to detect a grid stress event by a change in the mains frequency.

A voltage sensor can also be configured to measure a change in the mains voltage. The voltage sensor may be voltmeter configured to measure the mains voltage. The voltmeter can be configured to transmit the reading of the mains voltage to the controller 110 thereby to allow to the controller 110 to detect a grid stress event by a change in the mains voltage.

The mains sensor 450 may include a current sensor. A current sensor can be used to infer frequency of the mains power as well, but current wave shapes can be highly distorted with a lot of phase noise in a heat pump due to the inductance in a compressor motor and capacitance in the inverter, and therefore a voltage sensor is preferred. A current sensor can be used, in combination with the voltage sensor, to accurately determine the energy consumption associated with the heat pump. Measurement of both signals allows the controller to determine the power factor which will vary widely depending on the loading conditions of the heat pump and consequently the accuracy of power measurement via inference with a voltage or current sensor in isolation.

A power sensor may also be provided configured to measure a change in mains power to the system. The power sensor is configured to transmit the reading of the mains power to the controller 110 thereby to allow to the controller 110 to detect a grid stress event by a change in the mains power.

The illustrated arrangement therefore provides a means of measuring the heat transferred into or out of the heat-pump to measure the performance of the heat pump 102 (for example its efficiency, or coefficient of performance or other suitable metrics) over time and its relationship to external parameters such as: hot water temperature in the tank 104, temperature in the ambient environment from which heat is being taken/transferred to and the temperature of the indoor environment into which heat is being discharged/removed. This data can be used to determine a heat pump energy penalty under a present operating condition. The heat pump's performance may change over time, which can be measured by means of the heat meters arranged around the system. A performance degradation over time might be expected due to leakage of refrigerant within the system and/or a variety of other factors such as worn bearings and electrical breakdown of compressor 402 motor windings. These additional variables can be parametrised by a fatigue factor, which models a change in the heat pump's performance over a number of on-off cycles or over time.

The controller 110 may detect a grid stress event based on frequency and voltage measurements alongside allowable frequency set-points that the system is parameterised with. Frequency or voltage set-points might be updated periodically from an external signal from a utility, distribution network operator or aggregator. The current and voltage of the mains or grid electricity supply may be provided to the controller 110 directly by a grid operator, not necessarily from a local sensor. An example of a grid stress event that may trigger detection by the controller 110 might be where the frequency rises above or falls below a threshold level, for example by exceeding 50.1 Hz. This may be detected by a local sensor connected to the mains power which powers the heating system 100 or may be detected in another part of the grid and a signal containing this information transmitted to the controller 110. The grid stress event may also be detected by means of a ROCOF measurement where the slope of the frequency measurement rises above a certain value, for example, 0.1 Hz/sec. Similarly, a grid stress event may cause and be detected in dependence on the distribution voltage, or a rate of change thereof, rising above or falling below a threshold level. Rising above or dropping beneath particular frequency, ROCOF or voltage threshold values might bring about a detection of a grid stress event to which the heating system 100 responds. Different grids provide different levels of ordinary frequency fluctuations, so the threshold level (50.1 Hz in the example provided above) can be selected as appropriate for a particular grid.

The controller 110 is configured to implement an algorithm which combines the sensor data, such as the measurements from a heat measurement with the local mains power measurements, to determine whether to use the heat-pump or the electric heating element to respond to the grid stress event. The algorithm determines a heat pump energy penalty and based on this heat pump energy penalty the algorithm may provide a decision to respond to the grid stress event with the electric heating element 108 or the heat pump 102.

In a preferred embodiment, the algorithm is an optimisation algorithm configured to determine the heat pump energy penalty. The optimisation algorithm may determine the heat pump energy penalty in dependence on the present operating conditions of the system, a user requirement for energy, the known or predicted duration of the grid stress event, the nature of the grid stress event, a model of the performance of the heat pump 102 or any other relevant criteria. The optimisation algorithm may be a simplex algorithm or recurrent neural network. Where the optimisation algorithm is trained on training data, the training data may be historical data related to the performance of the heat pump 102, or other similar heat pumps (for example, in other buildings) over time and under different operating conditions. The training data may also comprise historical data related to grid stress events, such as the duration of previous unforeseen grid stress events.

In order to better understand the operation of the present invention, some exemplary grid stress event scenarios are provided to which a whole-house heating/cooling system might be required to react according to the present invention.

Scenario 1—a Grid Stress Event Anticipated by a Grid Operator

A grid stress event is predicted to occur in the early hours of the morning due to a weather system providing increased wind energy. A grid operator may therefore transmit a signal requiring a heating system 100 to absorb additional energy during this time period. This signal is received by the controller 110 of a home heating system 100. The grid stress event will last for 30 minutes in keeping with the cadence of the balancing market. Information about this grid stress event may have been provided through a direct message from the grid services provider, or less directly through an agile electricity tariff with variation in electricity costs every half an hour.

The heating system 100 has already analysed data that has been taken from multiple past heat-pump heating events for the hot water tank 104. This has enabled the system to parameterise the variation in heat pump energy penalty against key external parameters such as the ambient, heat source and refrigerant temperatures.

The controller 110 is aware of either an anticipated or scheduled demand for hot water, which may have been entered by the user or determined by learning from previous user behaviour. The controller 110 may also be aware of the current hot water volume and temperature in the tank 104. In this scenario, the controller 110 knows that more hot water will be required in the next few hours and it would be appropriate to respond to the grid stress event by absorbing energy in order to provide some of the anticipated need, as the heat loss from the hot water tank 104 will be minimal between now and time when it is required according to the schedule.

It is a relatively warm spring morning and the grid stress event is of comparatively long duration (30 minutes). The heat pump energy penalty determined by the controller 110 indicates that the investment of additional energy and fatigue to the heat pump 102 is acceptable since the greater coefficient of performance of the heat pump 102 at steady state, as compared to the electric heating element 108, will use the additional energy more efficiently. This may also have the advantage for the user that energy can be provided to the hot water tank 104 at lower overall cost. The controller 110 therefore switches on the heat pump 102 to provide hot water in response to the grid stress event.

Note that on a cold winter morning the final result may be rather different. The person skilled in the art will understand that the lower external temperature (for example, if the heat pump is a ground or air-source heat pump) may result in an additional performance drop of the heat pump 102, as the lower external temperature translates to a lower coefficient of performance. In this case, the heat pump energy penalty may be determined to be greater than that on the warm spring morning, which may lead to the electric heating element 108 being selected over the heat pump 102 to respond to the grid stress event.

Scenario 2—a Grid Stress Event Anticipated by a Grid Operator

A second grid stress event comprises a message from a grid operator requesting a reduction in the use of energy during a half hour period due to a change in weather forecast which is leading to lower anticipated solar energy production.

The whole house heating system 100 has already anticipated the need to provide further hot water in accordance with the normal routine of hot water usage within the house.

In the absence of the grid stress event, the controller 110 would typically choose to switch on the heat pump 102 to provide the additional hot water required. The hot water could then have been provided over a longer period, perhaps a few hours, by heating the hot water tank 104 to a high state of charge, thus avoiding the need to repeatedly provide shorter heating periods, with their associated reduced performance, even if only part of this hot water in the tank would be required in the near future.

With the additional knowledge of the grid stress event, the system instead chooses to heat the water in the tank using only the electric heating element 108, to provide for the immediate hot water needs of the user. The electric heating element 108 is switched on for a shorter period than had been anticipated for the heat pump 102 and is switched on outside the time window of the grid stress event. In response to the grid stress event, the system therefore has been controlled only to provide for the immediate hot water needs of the user by switching on the electric heating element 108.

Scenario 3—an Unforeseen Grid Stress Event

The heating system 100 may be required to respond to a grid stress event when the mains frequency goes above a certain threshold value. In some instances, the user of the heating system 100 may be required by a contract with a grid operator to respond to such events. The system may respond to such an event by absorbing excess energy through the hot water heating system 100. The heating of the hot water in the tank 104 may last until the frequency drops below that threshold, or heating may continue after the frequency drops below that threshold in order to satisfy a user heating requirement.

Long term frequency data from multiple whole house heating systems can be analysed to identify patterns and trends relating the duration of unforeseen grid stress events to other available parameters such as the frequency threshold, rate of change of frequency, recent mains frequency, transient frequency analysis and other relevant historical grid stress event data.

The controller 110 detects the change in mains frequency and thus detects the grid stress event. The controller 110 classifies this event initially as having unknown duration. Using a model built from the historical grid stress event data, which may be available locally to the controller 110 or via communication with a remote server, the controller 110 predicts the duration of the grid stress event. The model may also provide a measure of the uncertainty in this prediction. In an alternative, the controller 110 does not predict a duration of the grid stress event but will merely estimate a heat pump energy penalty for turning on the heat pump 102 in response to the main frequency threshold breach.

In this scenario, the grid stress event is predicted to last no more than a few minutes. The determined heat pump energy penalty indicates that the performance and wear and tear penalty associated with such a short duration for heat pump 102 heating are prohibitive, so the heating system 100 chooses to respond to the grid stress event by turning on the electric heating element 108.

In the examples described above grid stress events that require the heating system 100 to absorb power are discussed. Similar considerations apply for grid stress events that require the heating system 100 to refrain from absorbing power. In particular, a heat pump energy penalty is determined as an indicator of performance loss and wear and tear associated with switching the heat pump 102 off for the duration of a grid stress event, given a set of current operating conditions. The heating system 100 may respond to the grid stress event by turning off the heat pump 102 or the electric heating element 108. For example, if the grid stress event is only of short duration the inertia of the heating system may permit the heat pump 102 to resume operation without a significant penalty, whereas if the grid stress event is of a longer duration then re-starting the heat pump may come with a greater loss of efficiency and a greater heat pump energy penalty.

In some of the examples described above the controller chooses whether to switch on the electric heating element 108 or the heat pump 102. In other examples the controller can switch on the electric heating element 108 while the heat pump 102 remains on. Generally, the controller can determine a suitable distribution of power between the electric heating element 108 and the heat pump 102, be this an increase, decrease, or no change in the power to the electric heating element 108, the heat pump 102, both or neither.

Figure 5:
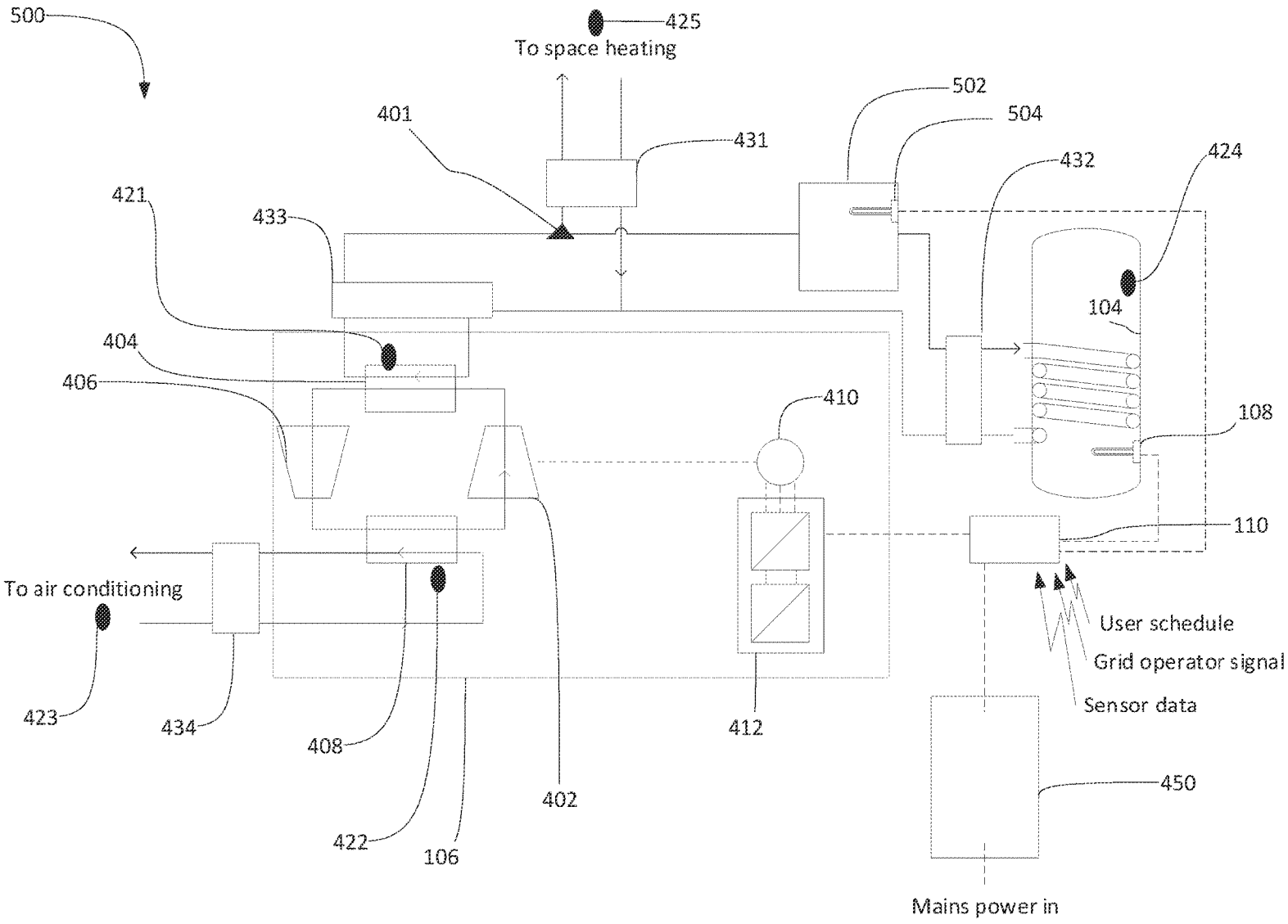
FIG. 5 shows a heating system according to certain embodiments of the invention including a buffer vessel.

FIG. 5 shows another example of a whole house heating and hot water system 500. This example is similar to the system 400 illustrated in FIG. 4 but with buffer vessel 502 arranged in the heating system. In this example the buffer vessel 502 is arranged upstream of the tank 104 but it will be appreciated that it may be provided elsewhere in the heating circuit. For example, it may be provided upstream of the space heating system and in particular upstream of the zone control valve 401 such that heat may be delivered from the buffer vessel 502 selectively to the space heating system or the hot water system.

The buffer vessel 502 provides a further means for storing heat in the heating system circuit. The buffer vessel 502 contains a volume of the fluid circulated through the system 500 that has been heated by the heat pump 102. The buffer vessel 502 can thus serve as a heat reservoir in the heating system circuit. The buffer vessel 502 can store heat and release it when opportune, for example for a defrosting cycle of the heat pump 102, or to reduce on/off cycling of the heat pump 102 as the dwelling is heated around its particular control set point temperature and hysteresis margin by the space heating system. For example, where the heat pump 102 is off and there is a need to provide space heating or heat water in the tank 104, the controller 110 may determine that there is sufficient heat stored in the buffer vessel 502 to satisfy that demand, thus obviating the need to switch on the heat pump. The controller 110 may make this determination in dependence on the heat pump energy penalty.

A buffer vessel heater 504 is provided to heat the fluid in the buffer vessel 502. In this example an electric heating element is disposed in the buffer vessel 502 to directly heat the fluid in the buffer vessel 502. Power is delivered from the mains power to the buffer vessel heater 504. The buffer vessel heater 504 is controlled by the controller 110. It will be appreciated that a buffer vessel heater 504 need not be provided in some embodiments.

A sensor (not shown) may be associated with the buffer vessel 502 to provide sensor data to the controller to provide relevant information about an operating condition of the buffer vessel 502 to the controller 110 in a similar way to that described in relation to the sensors 421, 422, 423, 424, 425, 431, 432, 433, 434. The sensor may be a temperature sensor for measuring the temperature of fluid in the buffer vessel. A heat meter may also be provided for measuring the flow of heat into or out of the buffer vessel 502 in similar way to that described in relation to heat meters 431, 432, 433, 434 and providing such information to the controller 110.

The controller 110 is configured to control whether to release heat from the buffer vessel 502 or whether to deliver heat to the buffer vessel 502. The buffer vessel 502 may also be passively heated by virtue of being in the circuit of heated fluid circulated by the heat pump 102. The controller 110 may determine that the buffer vessel 502 is to be heated by the buffer vessel heater 504, or by being replenished with heated fluid from the heat pump 102. The controller 110 is configured to determine whether to deliver heated fluid stored in the buffer vessel 502 into the heating system circuit for delivery to the tank 104, heat pump 102 or for space heating.

The buffer vessel 502 may similarly be used in response to a grid stress event so that the system 500 may increase or decrease its energy usage in order to reduce stress on the grid or to ensure that the grid remains within safe operational boundaries. The controller 110 is configured to determine whether to deliver heat to the buffer vessel 502 using the buffer vessel heater 504 or deliver heat from the buffer vessel 502 in response to the grid stress event. The buffer vessel thus provides an additional or alternative means to the electric heating element 108 of the tank 104 and the heat pump 102 for increasing or decreasing energy demand of the system 500 in response to a grid stress event. The buffer vessel 502 thus provides additional flexibility to the system.

In an example, the controller 110 may determine that a grid stress event requires that additional energy be absorbed by the system 500. The tank 104 may already be at a suitable or a maximum state of charge and there may be no demands on the space heating system. The additional energy may thus be absorbed by the buffer vessel 502. The controller 110 may determine whether to heat the buffer vessel 502 using the buffer vessel heater 504 or whether to deliver heat from the heat pump 102 to the buffer vessel 502 in dependence on the heat pump energy penalty.

In another example, the controller 110 may determine that a grid stress event requires that the system 500 uses less energy from the grid. In such a scenario, the controller 110 may use heat stored in buffer vessel 502 to satisfy a space heating or water heating demand.

The tank 104 may also be used in the same manner as the buffer vessel 502 as a 'virtual' buffer vessel. The tank 104 may perform this role in conjunction with the buffer vessel 502 or instead of the buffer vessel 502. For example, in response to a grid stress event the controller 110 may be configured to provide excess energy to the tank 104 for later use. The tank 104 may be heated, either by the heat pump 102 or the electric heating element 108 in dependence on the heat pump energy penalty, to a higher state of charge to absorb the excess energy from the grid. In another example, a grid stress event indicates that the heating system 500 may need to draw less energy from the mains power, the controller may then be configured to deliver heat stored in the tank 104 for space heating in order to satisfy a space heating demand as an alternative to providing heat from the heat pump 102 or electric heating element 108.

Where the tank 104 is used as a 'virtual' buffer vessel, the controller 110 may control the system 500 to provide the heat stored in the tank 104 to the space heating to satisfy a space heating demand or may control the system such that the heat in the tank 104 is transferred to the heat pump 102, for example to defrost the heat pump. This may occur in the usual course of use of the system 500 even in the absence of grid stress events in order to reduce a number of on/off cycles of the heat pump 102. The tank 104 in this regard operates both to provide hot water for a user and as a buffer vessel for the system 500. In general, the controller 110 is configured to determine whether to satisfy an energy demand, which may be one or more of a hot water demand, a space heating demand, a heat pump defrost demand or a demand in response to a grid stress event, using any of the heat pump 102, the electric heating element 112, heat stored in the tank 104 or (if provided) the buffer tank heater 504 or heat stored in the buffer vessel 502. The controller may do this based on the heat pump energy penalty as previously described, in response to a grid stress event but also in the absence of a grid stress event.

Various other modifications will be apparent to those skilled in the art. It will be understood that the present invention has been described above purely by way of example, and modifications of detail can be made within the scope of the invention.

Reference numerals appearing in the claims are by way of illustration only and shall have no limiting effect on the scope of the claims.

The invention claimed is:

1. A heating system comprising:
- a tank for holding water;
- a heat pump arranged to provide heat to the tank;
- an electric heating element disposed in the tank for heating water; and,
- a controller configured to:
  - control electric power from an electric power grid to the heat pump and the electric heating element;
  - detect a grid stress event;
  - determine a heat pump energy penalty incurred in starting up the heat pump for providing heat in response to the grid stress event under a present operating condition; and,
  - vary, in dependence on the determined heat pump energy penalty, a power provided to the electric heating element.

2. The system of claim 1, further comprising one or more of:
- a mains sensor arranged to measure a mains current frequency for detecting a grid stress event;
- a voltmeter arranged to measure a mains voltage for detecting a grid stress event; and
- a heat meter arranged to measure a heat flow of the heating system for determining the heat pump energy penalty in dependence on a characteristic performance profile of the heat pump.

3. The system of claim 1 wherein the grid stress event comprises a change in a mains current frequency or a change in a mains voltage.

4. The system of claim 1 wherein the controller is configured to determine a predicted duration of the grid stress event.

5. The system of claim 4 wherein the predicted duration of the grid stress event is determined based on a model.

6. The system of claim 1 wherein the controller is configured to determine the heat pump energy penalty in dependence on a known or predicted duration of the grid stress event.

7. The system of claim 1 wherein the controller is further configured to:

determine a user heating requirement;

determine the heat pump energy penalty in dependence on the user heating requirement; and select, in dependence on the determined heat pump energy penalty, either the heat pump or the electric heating element to satisfy the user heating requirement.

8. The system of claim 7 wherein the user heating requirement is a user heating schedule and/or a user hot water demand schedule.

9. The system of claim 1 wherein the controller comprises an optimisation algorithm configured to determine the heat pump energy penalty, optionally wherein the optimisation algorithm is a simplex algorithm or a recurrent neural network.

10. The system of claim 1 wherein the present operating condition comprises one or more temperature measurements comprising:

a temperature of a condenser of the heat pump;

a temperature of an evaporator of the heat pump;

a temperature of a space to be heated by the heating system;

a temperature of a space to be cooled by the heating system;

a temperature of hot water held in the tank;

a temperature of hot water at a point along the heating system; and, a temperature of refrigerant at a point along the heating system.

11. The system of claim 1 wherein the controller is configured to determine the heat pump energy penalty in dependence on a fatigue factor of the heat pump.

12. The system of claim 1 wherein the controller is configured to determine the heat pump energy penalty in dependence on a characteristic performance profile of the heat pump.

13. The system of claim 1 wherein the system comprises one or more heat meters arranged to measure a heat flow of the heating system, wherein the one or more heat meters are configured to measure one or more of:

(a) a heat flow from the heat pump to a space heating system;

(b) a heat flow from an air-conditioning system to the heat pump;

(c) a heat flow from the heat pump to the tank; and (d) a heat flow of any combination of (a)-(c).

14. The system of claim 1 wherein the grid stress event comprises a signal received from a grid operator, optionally wherein the signal is a prompt to increase or decrease an energy usage, optionally for a duration of time.

15. The system of claim 1 wherein the controller is configured to receive data from a remote server, optionally wherein the remote server is a remote server of a grid operator and the data comprises a signal from the grid operator associated with a grid stress event.

16. The system of claim 1 wherein the controller is configured to vary the power to the heat pump in dependence on the heat pump energy penalty.

17. The system of claim 1 wherein the controller is configured to vary the power to the electric heating element by controlling an on-off switching device.

18. The system of claim 1 further comprising:

a buffer vessel arranged between the heat pump and the tank for storing fluid circulated by the heat pump; and a buffer vessel heater for directly heating fluid in the buffer vessel, wherein the controller is further configured to control electric power from the electric power grid to the buffer vessel heater and vary, in dependence on the determined heat pump energy penalty, a power provided to the buffer vessel heater.

19. The system of claim 18 wherein the controller is further configured to:

determine a user heating requirement;

determine the heat pump energy penalty in dependence on the user heating requirement; and select, in dependence on the determined heat pump energy penalty, the heat pump, the electric heating element or heat stored in the buffer vessel to satisfy the user heating requirement.

20. A heating system comprising:

a water heating system for heating potable water and/or a space heating system;

a heat pump arranged to provide heat to the water heating system and/or a space heating system;

a buffer vessel arranged between the heat pump and the water heating system or space heating system for storing fluid circulated by the heat pump;

a buffer vessel heater for directly heating fluid in the buffer vessel;

a controller configured to:

control electric power from an electric power grid to the heat pump and the buffer vessel heater;

detect a grid stress event;

determine a heat pump energy penalty incurred in starting up the heat pump for providing heat in response to the grid stress event under a present operating condition; and, vary, in dependence on the determined heat pump energy penalty, a power provided to the buffer vessel heater.

21. The system of claim 20 wherein the buffer vessel heater comprises an electric heating element disposed in the buffer vessel for heating fluid in the buffer vessel.

22. A controller for a heating system comprising:

a grid stress event detector for detecting a grid stress event;

a data receiver for receiving sensor data;

a processor configured to determine a heat pump energy penalty incurred in starting up the heat pump for providing heat in response to a grid stress event in dependence on received sensor data; and, a power control module configured to vary the power provided to an electric heating element in dependence on the heat pump energy penalty.

* * * * *